US006794812B2

(12) United States Patent
Yamada et al.

(10) Patent No.: US 6,794,812 B2
(45) Date of Patent: Sep. 21, 2004

(54) LIGHT-EMITTING TUBE ARRAY DISPLAY DEVICE

(75) Inventors: Hitoshi Yamada, Kawasaki (JP); Akira Tokai, Kawasaki (JP); Manabu Ishimoto, Kawasaki (JP); Akira Nakazawa, Kawasaki (JP); Kenji Awamoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/428,084

(22) Filed: May 2, 2003

(65) Prior Publication Data

US 2003/0214225 A1 Nov. 20, 2003

(30) Foreign Application Priority Data

May 17, 2002 (JP) ..... 2002-143805

(51) Int. Cl.[7] ..... H01J 11/02; H01J 61/00

(52) U.S. Cl. ..... 313/493; 313/234; 313/491; 313/594; 313/607; 313/634

(58) Field of Search ..... 313/607, 634, 313/493, 234, 635, 643, 356, 491, 594

(56) References Cited

U.S. PATENT DOCUMENTS 5,514,934 A * 5/1996 Matsumoto et al. ..... 313/607

FOREIGN PATENT DOCUMENTS

JP 2000-315460 11/2000

* cited by examiner

*Primary Examiner*—Ashok Patel
(74) *Attorney, Agent, or Firm*—Staas & Halsey LLP

(57) ABSTRACT

A light-emitting tube array display device includes a light-emitting tube array, a flexible sheet and a plurality of electrodes. The light-emitting tube array is constituted of a plurality of light-emitting tubes arranged in parallel. Each of the light-emitting tubes consists of narrow tube having a phosphor layer disposed and discharge gas filled inside. The flexible sheet is capable of flatly supporting the light-emitting tube array and deforming the light emitting tube array in a direction perpendicular to a longitudinal direction of the light-emitting tubes. The plurality of electrodes are formed on a face of the flexible sheet opposed to the light-emitting tubes, which are capable of generating discharge inside the light-emitting tubes by an application of voltage. Each of the electrodes is formed of a metal film having a mesh pattern, a ladder pattern, or a comb-shape pattern.

11 Claims, 4 Drawing Sheets

LIGHT-EMITTING TUBE ARRAY DISPLAY DEVICE

CROSS-REFERENCE TO RELATED APPLICATION

This application is related to Japanese Patent Application JP2002-143805 filed on May 17, 2002, whose priority is claimed under 35 USC §119, the disclosure of which is incorporated by reference in its entirety.

BACKGROUND OF THE INVENTION

1. Field of the Invention

The present invention relates to a light-emitting tube array display device, and more particularly to a light-emitting tube array display device for displaying optional images, in which are arranged in parallel a plurality of light-emitting tubes (also referred to as "display tubes" or "gas discharge tubes") comprising narrow tubes of a diameter of approximately 0.5 to 5 mm having a phosphor layer disposed and discharge gas filled inside.

2. Description of Related Art

As such a display device described above, a display device described in, for example, Japanese Unexamined Patent Publication No. 2000-315460 is known. In such display devices, a plurality of light-emitting points are formed in a longitudinal direction of light-emitting tubes by, for example, forming a plurality of electrodes on a substrate supporting the light-emitting tubes, bringing an electrode-formed surface of the substrate into contact with the light-emitting tubes, and applying voltage to the electrodes.

In such display devices, for forming the electrodes on the substrate on the front side (display surface side), a transparent electro-conductive film of, for example, ITO is formed for transmitting light emitted from the light-emitting tubes. However, since the transparent electro-conductive film is high-resistant, the sole use thereof causes a voltage drop and a stable discharge characteristic can not be obtained. For this reason, a hybrid electrode which is a combination of a transparent electro-conductive film and a metal bus electrode has been used often until now.

However, in order to form such a hybrid electrode, steps of forming a film, patterning by a photolithography, and etching need to be repeated twice. Thus, many steps are required for forming such a hybrid electrode.

Besides, since the transparent electro-conductive film has poor ductility, the film may break as the substrate bends when the film is formed on a flexible PET (polyethylene terephthalate) substrate or the like.

Accordingly, there has been a demand for a flexible electrode which can be formed with a simple process and which is capable of following bending of the substrate.

SUMMARY OF THE INVENTION

The present invention has been made in view of these circumstances and an object thereof is to prevent breaking of electrodes caused by bending of a substrate and to improve the efficiency of taking out light emitted from light-emitting tubes, by forming the electrodes of a metal film having a mesh pattern, a ladder pattern or a comb-shape pattern.

The present invention provides a light-emitting tube array display device comprising: a light-emitting tube array constituted of a plurality of light-emitting tubes arranged in parallel, each of the light-emitting tubes consisting of narrow tube having a phosphor layer disposed and discharge gas filled inside; a flexible sheet for flatly supporting the light-emitting tube array and deforming the light emitting tube array in a direction perpendicular to a longitudinal direction of the light-emitting tubes; and a plurality of electrodes formed on a face of the flexible sheet opposed to the light-emitting tubes, for generating discharge inside the light-emitting tubes by an application of voltage, the electrodes each being formed of a metal film having a mesh pattern, a ladder pattern or a comb-shape pattern.

According to the present invention, the electrodes do not break even when the flexible sheet is deformed (bended) in the direction perpendicular to the longitudinal direction of the light-emitting tubes, since the electrodes comprise the metal film, of the mesh pattern, the ladder pattern or the comb-shape pattern having a plurality of openings through which light can be transmitted. Further, in discharge inside the light-emitting tubes, the present invention can improve the efficiency of taking out light emitted from the light-emitting tubes while maintaining a discharge characteristic similar to that when a transparent electrode of, for example, ITO or the like is used.

The following is a description of the present invention according to embodiments shown in figures. However, it should be understood that the present invention is not limited thereto and various modifications can be made.

DESCRIPTION OF THE PREFERRED EMBODIMENTS

Figure 1:
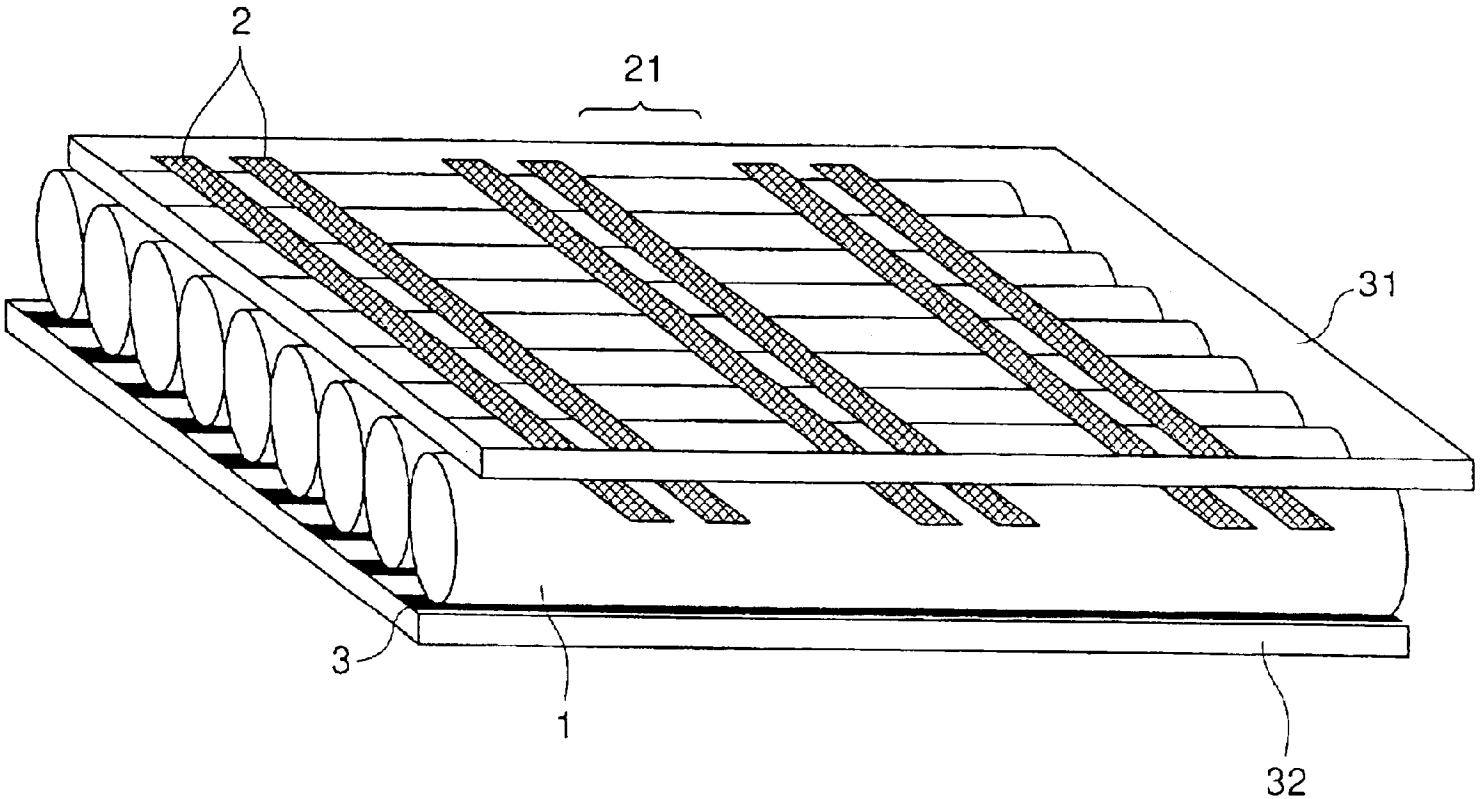
FIG. 1 is a view illustrating an overall construction of the display device of the present invention.

In the present invention, the light-emitting tube array may be used that is constituted of a plurality of light-emitting tubes arranged in parallel and consisting of narrow tubes each having a phosphor layer disposed and discharge gas filled inside. Various kinds of light-emitting tubes known in the art are applicable as the light-emitting tubes of the light-emitting tube array described above. The light-emitting tubes may be formed using narrow tubes of any diameter, but are preferably formed using narrow glass tubes of a diameter of approximately 0.5 to 5 mm. Preferably, the narrow tubes have a circular cross section but may have a flat oval cross section.

The flexible sheet may be used that is capable of flatly supporting the light-emitting tube array and deforming it in the direction perpendicular to the longitudinal direction of the light-emitting tubes. It is desirable that the flexible sheet be constituted of a light transmittable film sheet. As a film used for this film sheet, a commercially available polycarbonate film, a PET (polyethylene terephthalate) film or the like can be used. It is desirable that the flexible sheet be composed of a pair of flexible sheets on a display surface side and a rear side for sandwiching the light-emitting tubes therebetween.

The electrodes may be used that are formed on the light-emitting tube opposed face of the flexible sheet and that are capable of generating discharge inside the light-emitting tubes by an application of voltage. However, the electrodes need to be formed of the metal film having the mesh pattern, the ladder pattern or the comb-shape pattern and to have the openings for transmitting light. These electrodes may be formed using methods and materials known in the art. For example, the electrodes may be formed as electrodes having a light-transmitting portion by forming a layer of copper or the like on the light-emitting tube opposed face of the flexible sheet by a low-temperature sputtering method or a vapor deposition method, and then patterning a resist for electrodes using a photolithography technique and etching the layer. The electrodes may be formed by forming a layer of a metal such as nickel, aluminum, silver or the like by a sputtering method, a vapor-deposition method, a printing method or the like, and then patterning a resist for electrodes and etching the layer.

It is desirable that pitches of the electrode pattern (a rung pitch of the ladder pattern or a teeth pitch of the comb-shape pattern), in a direction crossing the longitudinal direction of the light-emitting tubes, be an integral multiple of a pitch of the light-emitting tubes provided when the tubes are aligned. Such construction allows each light-emitting tube to always oppose the same number of electrode patterns when the flexible sheet having the electrodes is attached to the light-emitting tube array, eliminating the need of aligning the electrodes with the light-emitting tubes. In this construction, from the view point of the efficiency of taking out light emitted from the light-emitting tubes, it is desirable that the openings of the electrodes in the centers of light-emitting points of the light-emitting tubes have a bigger area than those in their periphery.

FIG. 1 is a view illustrating an overall construction of the display device of the present invention.

In the display device of the present invention, for displaying optional images, there are arranged in parallel a plurality of light-emitting tubes comprising narrow tubes of a diameter of approximately 0.5 to 5 mm having a phosphor layer disposed and a discharge gas filled inside.

In this figure, the reference numeral 31 refers to a flexible sheet constituting a substrate (support member) on the front side (display surface side), the reference numeral 32 refers to a flexible sheet constituting a substrate (support member) on the rear side, the reference numeral 1 refers to a light-emitting tube, the reference numeral 2 refers to a display electrode pair (main electrode pair), and the reference numeral 3 refers to a data electrode (also referred to as a signal electrode).

The flexible sheet 31 on the front side is formed of a transparent PET film and the flexible sheet 32 on the rear side is formed of an opaque PET film. A tubular vessel of the light-emitting tube 1 is formed of borosilicate glass or the like.

The display electrode pair 2 is formed on a light-emitting tube opposed face of the flexible sheet 31 on the front side. This display electrode pair 2 is a mesh patterned electrode, a ladder patterned electrode or a comb-shape patterned electrode having a plurality of openings capable of transmitting light emitted from the light-emitting tube to the display surface side. The display electrode pair 2 is formed by forming a layer of copper, nickel, aluminum, silver or the like by a low-temperature sputtering method, a vapor-deposition method, a printing method or the like, and then patterning the layer using a known photolithography technique and etching.

The data electrode 3 is formed on a light-emitting tube opposed face of the flexible sheet 32 on the rear side. This data electrode is also formed of a metal such as copper, nickel, aluminum, or the like by the low-temperature spattering method, the vapor deposition method, the printing method or the like. This data electrode 3 is not provided with openings since there is no need to transmit light emitted from the light-emitting tubes to the rear side.

A phosphor layer (not shown) is provided and discharge gas is introduced inside the light emitting tube 1 (discharge space), and both ends of the light-emitting tube 1 are sealed. More than one light-emitting tube 1 arranged in parallel composes a light-emitting tube array. The data electrode 3, as described above, is formed on the flexible sheet 32 on the rear side and provided to be in contact with the light emitting tube 1 along a longitudinal direction of the light-emitting tube. The display electrode pair 2 is formed on the flexible sheet 31 on the front side and provided to be in contact with the light-emitting tubes 1 in a direction crossing the data electrodes 3. A non-discharge region (non-discharge gap) 21 is provided between the display electrode pairs 2.

The data electrode 3 and the display electrode pair 2 are brought into close contact with the lower outer periphery and the upper outer periphery of the light emitting tube 1, respectively, during assembly. An adhesive can be sandwiched between the display electrode and the light-emitting tube surface to improve adhesion.

In the display device as seen in a plan view, a cross portion of the data electrode 3 and the display electrode pair 2 acts as a unit light emission region (unit discharge region). Display is performed by using one of the display electrode pair 2 as a scanning electrode to generate a selective discharge in the cross portion of the scanning electrode and the data electrode 3, for selecting a light emission region and by then generating a display discharge between the display electrode pair 2 by utilizing a wall charge formed on the internal surface of the tube in the region with the light emission. The selective discharge is an opposite discharge generated in the light-emitting tube 1 between the scanning electrode and the data electrode 3 which are opposed to each other with the light-emitting tube interposed therebetween, and the display discharge is a surface discharge generated in the light-emitting tube 1 between two display electrodes arranged in parallel on a plane.

By such electrode arrangement, a plurality of light-emitting points are formed in the light-emitting tube 1 in its longitudinal direction.

In an electrode structure shown in the figures, three electrodes are arranged in one light emission portion and a display discharge is generated between the display electrode pair. However, the electrode structure of the present invention is not limited thereto, and may be such that the display discharge is generated between the display electrode 2 and the data electrode 3.

In other words, the electrode structure may be such that by using only one display electrode of the display electrode pair 2 as the scanning electrode, the selective discharge and the display discharge (opposed discharge) are generated between the data electrode 3 and the display electrode 2.

Figure 2:
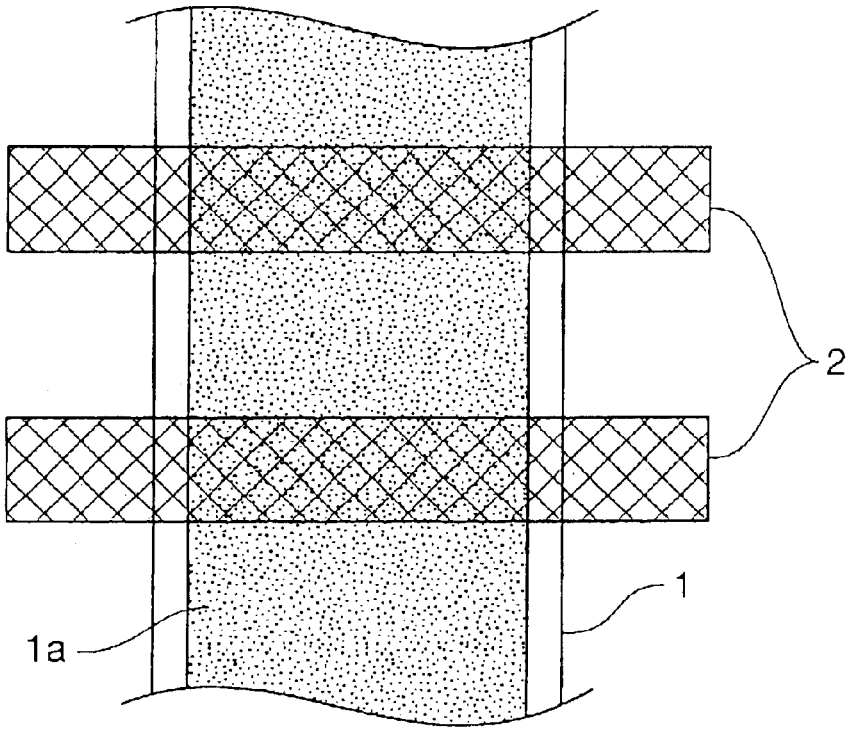
FIGS. 2(*a*) and 2(*b*) are views illustrating one light-emitting tube of the embodiment.
Figure 2:
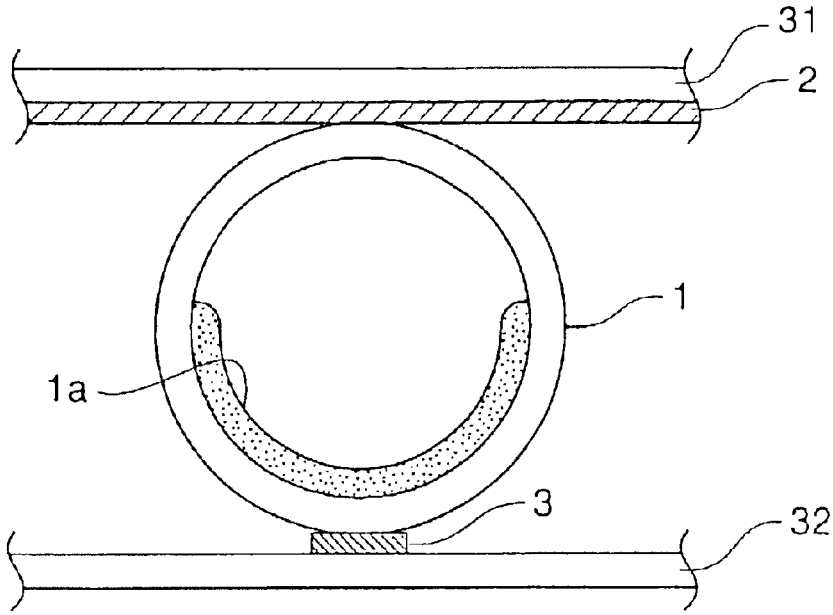

FIGS. 2(*a*) and 2(*b*) illustrate one light-emitting tube of the embodiment. FIG. 2(*a*) shows the light-emitting tube as seen in a plan view and FIG. 2(*b*) shows a cross section of the light-emitting tube perpendicular to its longitudinal direction. In the figure, the reference numeral 1*a* refers to a phosphor layer.

The tubular vessel of the light-emitting tube 1 has a circular cross section, is made of Pyrex (registered trademark: heat resistant glass made by Corning Inc., U.S.A.), and has an outside diameter of 1 mm, a wall thickness of 100 μm, and a length of 400 mm.

A narrow glass tube constituting the tubular vessel of the light-emitting tube 1 is made by producing a large glass base material of a figure similar to the light-emitting tube 1 by Danner Process and redrawing (extending) the base material while softening it by heating. The phosphor layer 1*a* is disposed inside the light-emitting tube 1.

The display electrode pair 2 is arranged in the direction perpendicular to the longitudinal direction of the light-emitting tube 1, and provided in a mesh pattern by forming a copper layer on the light-emitting tube opposed face of the flexible sheet 31 on the front side by the low-temperature sputtering method, and then patterning the layer by the photolithography technique and etching. Thus, the display electrode pair 2 is formed of a metal film having the mesh pattern. In addition to the above method, the electrodes can be formed by using a printing method such as a screen printing or an ink-jet printing or by using mesh-patterned metal wires.

The data electrode 3 is arranged along the light-emitting tube 1 and provided by forming copper on the light-emitting tube opposed face of the flexible sheet 32 on the rear side by the low-temperature sputtering method. In addition to the above, a metal such as nickel, aluminum, silver or the like can be used as a material to form the electrode. Furthermore, the data electrode 3 may be formed by printing carbon black dispersed in a resin such as polyamide.

Figure 3:
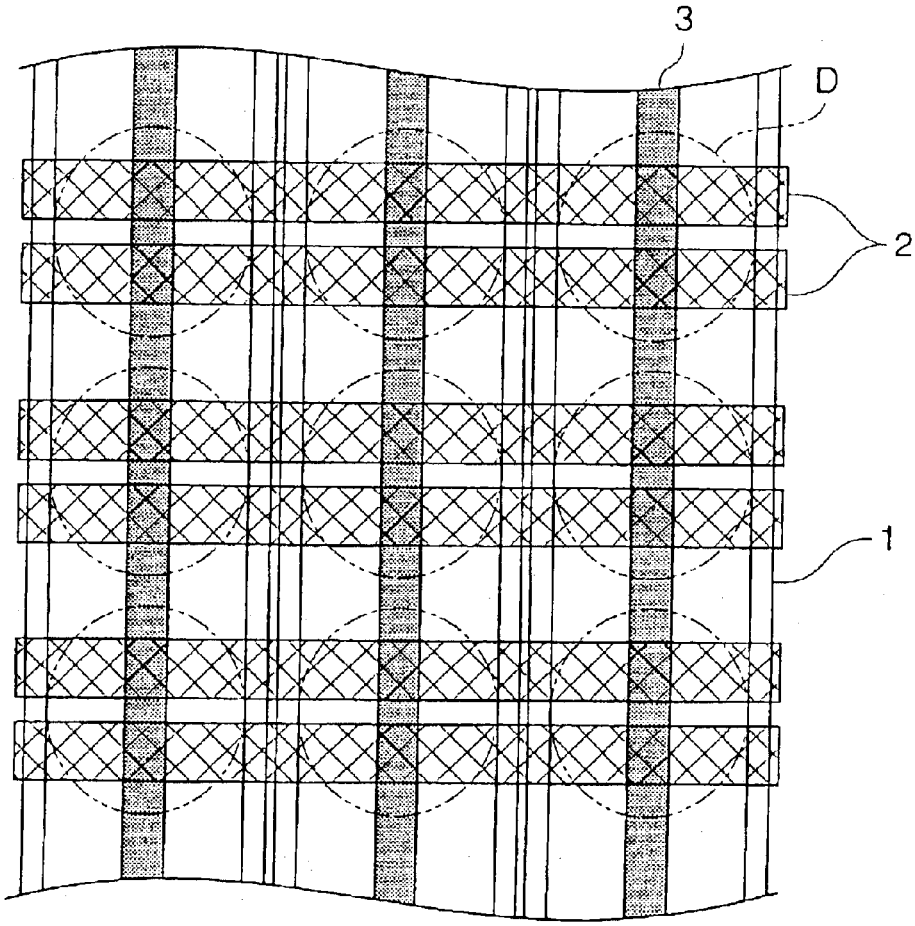
FIG. 3 is a view illustrating a display device of the embodiment as seen in a plane view.

FIG. 3 is a view partially illustrating the display device as seen in a plane.

In this figure, the reference mark D refers to a unit discharge region that is a portion where the display electrode pair 2 crosses the data electrode 3. Emitted light from the light-emitting tube 1 is transmitted to the display surface side since each of the display electrodes is formed as the mesh patterned electrode and spaces in the mesh act as the openings for light transmission. In other words, a transmission efficiency of light emitted from the light-emitting tube 1 to the display surface side is increased by forming an opaque metal electrode film into a mesh having openings for light transmission.

Since a wall thickness of the tubular glass vessel of the light-emitting tube 1 is 50 to 100 μm, an electric potential distribution inside the light-emitting tube 1 is not affected even if an opening ratio of the electrode is increased to about 70%. Therefore, a discharge characteristic is barely affected.

Accordingly, light emitted from the light-emitting tube 1 can be sufficiently transmitted to the display surface side. Since the electrode is mesh patterned and the electric potential distribution inside the light-emitting tube is about the same as that obtained when a solid metal electrode is formed, the electric potential distribution inside the light-emitting tube can be constant. Further, the display electrode pair 2 does not break even when the light-emitting tube array is bent in the direction perpendicular to the longitudinal direction of the light-emitting tube, that is, when the flexible sheets on the front side and the rear side are bent in the direction perpendicular to the longitudinal direction of the light-emitting tube.

Figure 4:
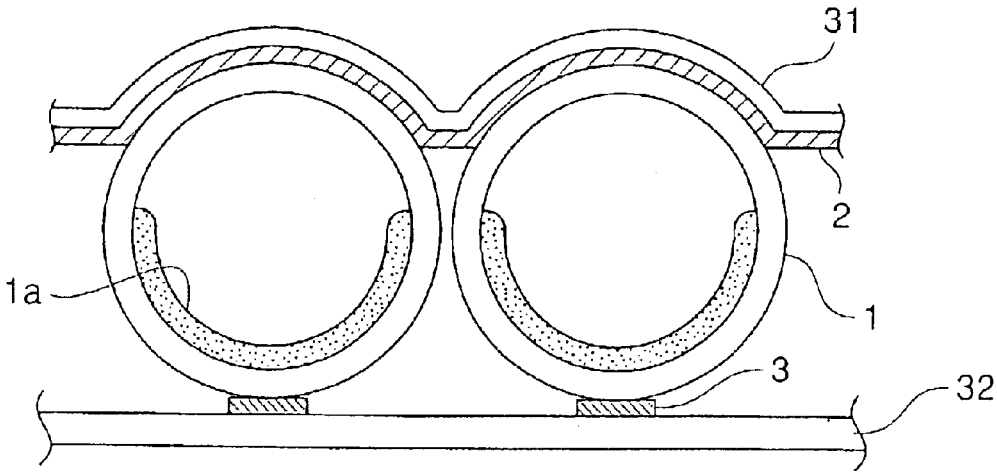
FIG. 4 is a view illustrating an example when a flexible sheet on the front side of the display device of the embodiment is deformed along the outer wall surface of the light-emitting tube.

FIG. 4 is a view illustrating an example when the flexible sheet on the front side is deformed along the outer wall surface of the light-emitting tube. This figure shows a cross section perpendicular to the longitudinal direction of the light-emitting tube.

As shown in the figure, even when the flexible sheet 31 on the front side is deformed along the outer wall surface of the light-emitting tube 1, the display electrode pair 2 can run along the outer wall surface of the light-emitting tube 1 without breaking, since the display electrode pair 2 formed with the metal film having the mesh pattern follows the shape of the flexible sheet 31 on the front side. Accordingly, electrode areas can be uniform and a high-quality display can be provided. In this example, the support member on the rear side may be a rigid body.

When discharge is generated inside the light-emitting tube 1 by applying voltage to the display electrode pair 2, discharge voltage can be decreased in comparison to that obtained when the flexible sheet 31 and the display electrode pair 2 are in the state shown in FIG. 2(*b*), since a contact area of the display electrode pair 2 and the light-emitting tube 1 can be enlarged by the above construction.

Figure 5:
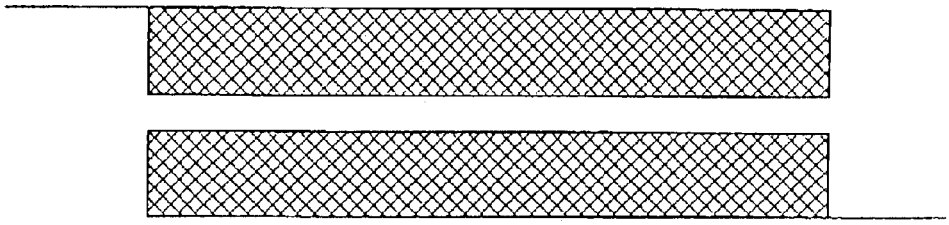
FIGS. 5(*a*) to 5(*e*) are views illustrating examples of display electrode pairs of the embodiment.
Figure 5:
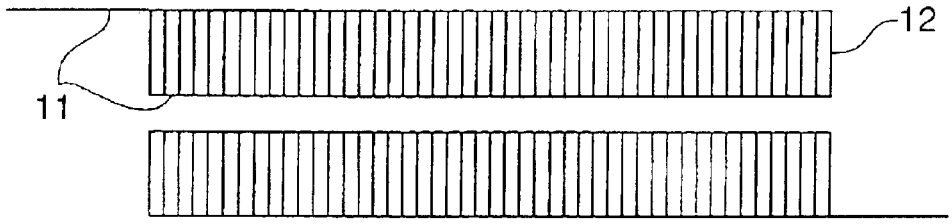
Figure 5:
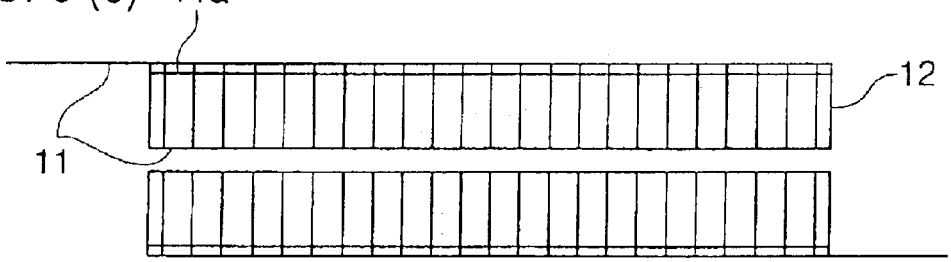
Figure 5:
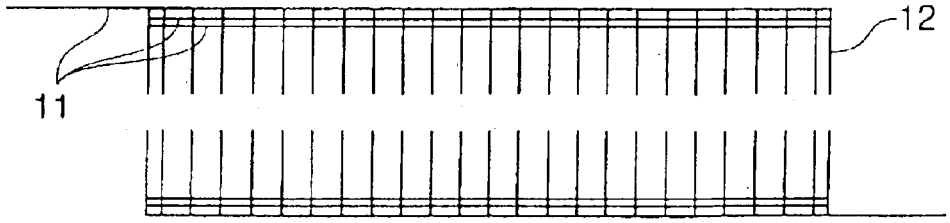
Figure 5:
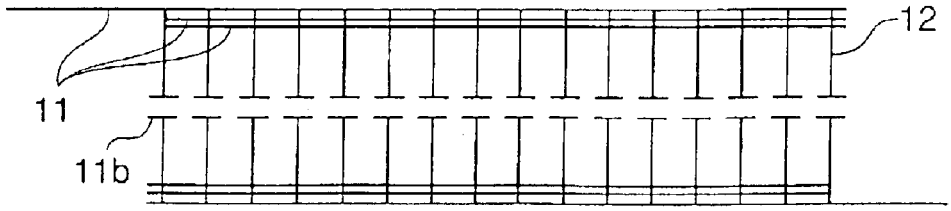

FIG. 5(*a*) to FIG. 5(*e*) are views illustrating examples of the display electrode pair.

FIG. 5(*a*) shows a display electrode pair with each electrode formed to have the mesh pattern as described above.

FIG. 5(*b*) shows a display electrode pair with each electrode formed to have a ladder pattern. The ladder patterned electrode is composed of two connecting electrode wires 11 extending in the direction crossing the longitudinal direction of the light-emitting tube and split electrode wires 12 extending in the longitudinal direction of the light-emitting tube from the connecting electrode wires 11. This configuration allows the opening ratio of the electrode to be higher than that of the mesh patterned electrode.

As seen in a plan view, a wire width of the connecting electrode wire 11 is approximately 70 to 100 μm. When the opening ratio of the electrode is set to 50%, 10 split electrode wires 12 are provided for one light-emitting tube of a width of 1000 μm since a wire width of the split electrode wire 12 is about 50 μm. If the opening ratio of the electrode is 75%, 5 split electrode wires 12 are provided for one light-emitting tube.

From the view point of easy patterning and a bending strength, it is desirable that a width of the electrode wire be 30 μm or more. When uniformity of discharge fields is considered, it is desirable that three split electrode wires or more, if possible, 5 split electrode wires or more be provided for one light-emitting tube. From this point of view, when the opening ratio of the electrode is set to 50 to 60%, it is desirable that wire widths of the connecting electrode wire 11 and the split electrode wire 12 be approximately 50 to 80 μm.

A rung pitch of the ladder patterned electrode in the direction crossing the longitudinal direction of the light-emitting tube is an integral submultiple of a pitch of the light-emitting tube obtained when the tubes are aligned. Therefore, when the flexible sheet on the front side having the display electrode pairs formed thereon is attached to the light-emitting tube array, each light-emitting tube is always opposed to the same number of split electrode wires 12, thereby eliminating the need of aligning the ladder patterned electrodes with the light-emitting tubes.

FIG. 5(*c*) shows another example of the ladder patterned electrode pair of FIG. 5(*b*). Each electrode of FIG. 5(*c*) has bigger intervals provided between adjacent rungs and second connecting electrode wires 11*a* added in the direction crossing the longitudinal direction of the light-emitting tube in order to prevent its breaking. FIG. 5(*d*) shows a display electrode pair with each electrode formed to have a comb-shape pattern. The comb-shaped electrode is composed of three connecting electrode wires 11 extending in the direction crossing the longitudinal direction of the light-emitting tube and split electrode wires 12 extending in the longitudinal direction of the light-emitting tube from the connecting electrode wires 11. This configuration allows a light transmitting portion of the display electrode pair to have a bigger area at the center of the light-emitting point of the light-emitting tube than around the periphery, and thereby allows the opening ratio of the electrode to be increased at the portion close to the center of the light-emitting point, resulting in improvement of the efficiency of taking out light emitted from the light-emitting tube compared to that of the electrode configuration shown in FIG. 5(*c*).

FIG. 5(*e*) shows another example of the comb-shape patterned electrode shown in FIG. 5(*d*). This comb-shape patterned electrode has, on tips of the split electrode wires 12, short wires 11*b* extending in the direction crossing the longitudinal direction of the light-emitting tube. Owing to this construction, the electric potential distribution is corrected in the intervals between the display electrode pair which affect firing potential, the opening ratio of the electrode is increased at the portion close to the center of a light-emitting point in a cell.

In all of these electrode examples, the intervals between the split electrode wires, in other words, pitches in the electrode are each set to an integral submultiple of a pitch of the light-emitting tube provided when the tubes are aligned, in other words, a cell pitch. This eliminates the need of horizontally aligning the flexible sheet on the front side having the display electrode pair formed thereon with the light-emitting tube array.

Furthermore, in the display electrode pair 2, the efficiency of taking out emitted light can be increased by raising the opening ratio on a light emission center side of the electrode, since the light emission center is produced between the electrodes.

Thus, since the electrodes to be formed on the flexible sheet are made of the metal film having the mesh pattern, the ladder pattern or the comb-shape pattern, it is possible to provide a bendable light-emitting tube array (display device) which does not break even when the flexible sheet is bent and which is capable of sufficiently transmitting light emitted from the light-emitting tube to the display surface side while maintaining a discharge characteristic equal to that of a metal electrode with no openings for light transmission. Also, in formation of the electrodes, there is no need to repeat twice the steps of forming the metal film, patterning by the photolithography and etching as for the hybrid electrodes. Accordingly, the steps are performed only once and thus the number of the steps to be performed for an electrode forming process can be reduced.

According to the present invention, since the electrodes to be formed on the flexible sheet are formed of the metal film having the mesh pattern, the ladder pattern or the comb-shape pattern, breaking of the electrodes when the flexible sheet is bent can be avoided and emitted light of the light-emitting tube can be taken out efficiently. Moreover, the number of steps performed for the electrode forming process can be reduced compared to that for hybrid electrodes, thereby making it possible to cut down costs. Accordingly, a high-quality display device having a flexible display surface can be provided at low price.

What is claimed is:

1. A light-emitting tube array display device comprising:

a light-emitting tube array comprised of a plurality of light-emitting tubes arranged in parallel, each of the light-emitting tubes comprising a narrow tube having a phosphor layer disposed and discharge gas filled inside;

a flexible sheet to flatly support the light-emitting tube array and deform the light emitting tube array in a direction perpendicular to a longitudinal direction of the light-emitting tubes; and a plurality of electrodes formed on a face of the flexible sheet opposed to the light-emitting tubes, to generate discharge inside the light-emitting tubes by an application of voltage, the electrodes each being formed of a metal film having a mesh pattern, a ladder pattern, or a comb-shape pattern;

wherein the electrodes extend in continuity over the plurality of the light-emitting tubes, in the direction perpendicular to the longitudinal direction of the light-emitting tubes.

2. A light-emitting tube array display device according to claim 1, wherein the flexible sheet comprises a light transmittable film sheet.

3. A light-emitting tube array display device according to claim 1, wherein the flexible sheet comprises a pair of flexible sheets on a display surface side and a rear side for sandwiching the light-emitting tubes therebetween.

4. A light-emitting tube array display device according to claim 1, wherein a pitch of the ladder pattern or the comb-shape pattern of the electrode, in a direction crossing the longitudinal direction of the light-emitting tubes, is an integral multiple of a pitch of the light-emitting tube provided when the tubes are aligned.

5. A light-emitting tube array display device according to claim 1, wherein an opening of the electrode in the center of a light-emitting point of the light-emitting tubes is formed to be bigger than that in the periphery.

6. A light-emitting tube array display device comprising:

a light-emitting tube array constituted of a plurality of light-emitting tubes arranged in parallel, each of the light-emitting tubes comprising a narrow tube having a phosphor layer disposed and discharge gas filled inside;

a flexible sheet abutting the light-emitting tube array to support the light-emitting tubes, and a plurality of electrodes formed on the face of the flexible sheet opposed to the light-emitting tubes, to generate discharge inside the light-emitting tubes by the application of voltage, wherein the electrodes are formed of a metal film having a mesh pattern, a ladder pattern, or a comb-shape pattern, and the flexible sheet has a shape that follows the light-emitting tubes so as to allow the electrodes to come into contact with the light-emitting tubes along a surface shape of the light-emitting tubes.

7. A light-emitting tube array display device comprising:

a light-emitting tube array constituted of a plurality of light-emitting tubes;

a flexible sheet to support the light-emitting tube array; and a plurality of electrodes formed on a face of the flexible sheet opposed to the light-emitting tubes, to generate discharge inside the light-emitting tubes by an application of voltage, the electrodes each being formed of a film having a mesh pattern, a ladder pattern, or a comb-shape pattern.

8. A light-emitting tube array display device according to claim 7, wherein the flexible sheet comprises a light transmittable film sheet.

9. A light-emitting tube array display device according to claim 7, wherein the flexible sheet comprises a pair of flexible sheets on a display surface side and a rear side for sandwiching the light-emitting tubes therebetween.

10. A light-emitting tube array display device according to claim 7, wherein a pitch of the ladder pattern or the comb-shape pattern of the electrode, in a direction crossing a longitudinal direction of the light-emitting tubes, is an integral multiple of a pitch of the light-emitting tube provided when the tubes are aligned.

11. A light-emitting tube array display device according to claim 7, wherein an opening of the electrode in the center of a light-emitting point of the light-emitting tubes is formed to be bigger than that in the periphery.

* * * * *